United States Patent [19]

Silvia

[11] Patent Number: 4,989,516

[45] Date of Patent: Feb. 5, 1991

[54] SAFE/ARM EXPLOSIVE DELAY PATH

[75] Inventor: Denis A. Silvia, Aberdeen, Md.

[73] Assignee: The United States of America as represented by the Secretary of the Navy, Washington, D.C.

[21] Appl. No.: 279,643

[22] Filed: Jul. 2, 1981

[51] Int. Cl.[5] ..... F42C 19/08

[52] U.S. Cl. ..... 102/275.9; 102/202; 102/275.2; 102/305; 102/701

[58] Field of Search ..... 102/275.1, 275.2, 275.3, 102/275.4, 275.6, 275.7, 275.8, 275.9, 202, 202.1, 221, 222, 701, 215

[56] References Cited

U.S. PATENT DOCUMENTS

| | | | |
|---|---|---|---|
| 3,496,868 | 2/1970 | Silvia et al. | 102/305 |
| 3,669,021 | 6/1972 | Spencer et al. | 102/275.2 |
| 3,728,965 | 4/1973 | Silvia | 102/701 X |
| 3,753,402 | 8/1973 | Menz et al. | 102/701 X |
| 3,768,409 | 10/1973 | Menz et al. | 102/275.9 |
| 3,973,499 | 8/1976 | Anderson et al. | 102/202 |

*Primary Examiner*—David H. Brown

*Attorney, Agent, or Firm*—John D. Lewis; Kenneth E. Walden

[57] ABSTRACT

A safe/arm explosive delay path for detonating an explosive device and preventing detonation of the explosive device by extraneous factors present in the internal environment. The delay path comprises a detonator and first explosive trail leading to a delay explosive trail composed of explosive material and reactive material. A second explosive trail is connected to the first explosive trail and parallel to the delay explosive trail. The delay trail and second explosive trail terminate in an explosive junction. The explosive junction or explosive switch is a gated diode with the delay trail leading through the diode in the second explosive trail functioning to gate the diode. The gated diode allows a detonation wave propagating through the delay tail to proceed to the explosive device only when a detonation wave has propagated along the second explosive trail and gated the explosive diode prior to the arrival of the delay detonation wave. The delay trail is composed of a mixture of explosive and reactive material such that the detonation velocity is ½ to 1/10 the velocity of ordinary or secondary explosive.

20 Claims, 2 Drawing Sheets

SAFE/ARM EXPLOSIVE DELAY PATH

BACKGROUND OF THE INVENTION

The present invention relates to an explosive delay path for detonating an explosive device and more particularly to a safe/arm explosive delay path which provides explosive logic for detonating an explosive device while preventing inadvertent detonation of the device from extraneous factors in the external environment.

A conventional explosive train consists of a fuze, detonator, safe/arm mechanism, booster charge, and explosive device or warhead. The safe/arm mechanism is interposed between the detonator and booster to protect the explosive device from accidental detonation. The prior art approach in safe/arm mechanisms has been the out-of-line method whereby the detonator is separated from the booster by one or more physical barriers. Accidental detonation of the detonator can not penetrate the physical barrier and detonate the warhead. Although this method is simple and direct, it provides insufficient reliability and safety when subjected to external environmental factors due to space requirements and the necessary moving parts. To combat these deficiencies, alternative safe/arm methods known as in-line devices, have been devised to eliminate the out-of-line method. These proposed devices are of two types: high power devices and low power devices.

In the high power method the primary explosive detonator is replaced with a high power electrical detonator having no primary explosive. The detonator can thus be placed in direct line with the main charge. This does not eliminate the requirement for a safe/arm mechanism because the high power electrical supply must be isolated from the warhead by an electrical safe/arm mechanism. Other disadvantages of the high power electrical detonator are the high cost of each detonator and the high space requirements of each detonator.

The low power devices use detonators which contain primary explosive. When the fuze makes the decision to detonate the explosive device or warhead, it generates an electrical code. The fuze code detonates the primary explosive detonators. The safe/arm mechanism then examines and/or verifies the detonation sequence from the primary explosive detonators before passing it on to detonate the explosive device or warhead. The safe/arm explosive delay path of the present invention is a low power mechanism which allows the use of a primary explosive detonator.

SUMMARY OF THE INVENTION

Accordingly, there is provided in the present invention a safe/arm explosive delay path for detonating an explosive device and preventing the inadvertent detonation of the device by extraneous environmental factors.

The safe/arm explosive delay path is constructed with an explosive delay trail positioned between the detonator and the explosive device. The delay trail is composed of a mixture of explosive and reactive material generally having a reaction velocity of ½ to 1/10 the reaction velocity of ordinary or secondary explosive. A first explosive trail of secondary explosive leads from the detonator to the delay explosive trail. A second explosive trail branches off the first explosive trail and parallels the delay explosive trail. The delay explosive trail terminates at a booster charge with a safety junction or explosive switch leading to the explosive device or warhead. The explosive switch is a gated explosive diode with the second explosive trail, which parallels the delay explosive trail, functioning to gate the explosive diode. When a detonation wave is propagated by the detonator in the first explosive trail and transferred to the delay explosive trail, a second detonation wave is propagated off the first detonation wave in the second parallel explosive trail. When the second detonation wave reaches the explosive diode, the diode is gated to allow propagation of the original or first detonation wave through the gated diode or explosive switch to detonate the explosive device or warhead.

OBJECTS OF THE INVENTION

It is an object of the present invention to provide a safe/arm explosive delay path for preventing inadvertent detonation of an explosive device by extraneous environmental factors.

Another object of the present invention is to provide a time delay path for initiating an explosive device.

Another object of the present invention is to provide a safe/arm explosive delay path which enables detonation of an explosive device by a primary explosive detonator.

A further object of the present invention is to provide an explosive delay path which reduces the length of the explosive trail required for a given delay time.

Other objects, advantages and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
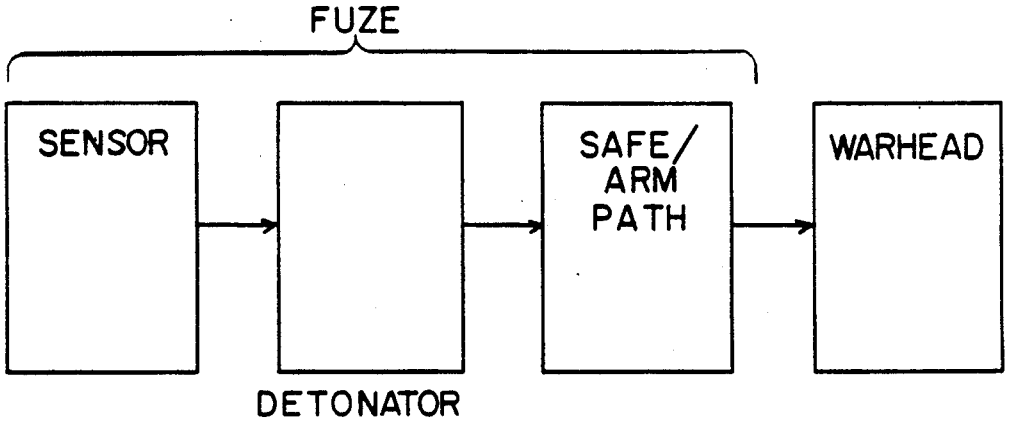
FIG. 1 illustrates a conventional explosive train.

Referring to FIG. 1, there is shown a block diagram of an explosive train for detonating an explosive device such as a warhead. The sensor element of the fuze initiates the explosive train by sending a code to the detonator which may be a primary explosive such as PETN or RDX. On command from the fuze, the detonator initiates a detonation wave through an explosive trail of secondary explosive which proceeds through the safe/arm path or mechanism to arrive at the warhead. The safe/arm mechanism may be provided with a booster charge, not shown in FIG. 1, if the safe/arm path detonation wave does not contain enough energy to directly detonate the secondary explosive of the warhead.

Figure 2:
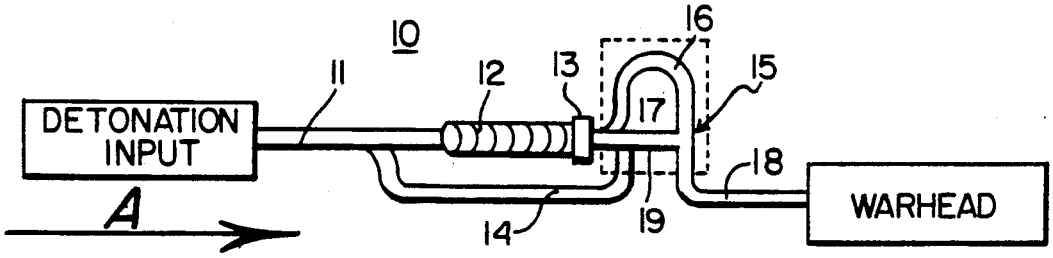
FIG. 2 illustrates the safe/arm explosive delay path of the present invention.

Referring to FIG. 2, there is illustrated the explosive delay path of the present invention, illustrated as numeral 10. The explosive delay path propagates a detonation wave from the detonation input to the warhead in the direction indicated by arrow A. The delay path functioning is initiated by the electrical code sent by the fuze, not shown in FIG. 2. The input initiates a detonation wave in a first explosive trail 11 which is composed of a secondary explosive such as PETNEXTEX or RDXEXTEX. The PETNEXTEX (PBXN-301) is composed of 80% PETN and 20% SYLGARD rubber which is a silicone room temperature vulcanizing rubber, while the RDXEXTEX is composed of 90% RDX and 10% SYLGARD rubber.

The first explosive trail propagates the detonation wave to a delay explosive trail 12 which is composed of a mixture of explosive and/or reactive material. The reactive material, as contrasted to high explosive, burns slower than the velocity of sound in the material. The reactive material may be a commercial material such as HIVALITE or similar material composed of a metal fuel and oxidizer, for example THERMITE, having iron oxide and aluminum. The mixture of explosive and reactive material has a detonation velocity of 1/2 to 1/10 the detonation velocity of ordinary or secondary explosive. Ordinary explosives such as a secondary explosive such as EXTEX, used in the first explosive trail 11, have a detonation velocity approximately of 0.7 mm to 3.5 mm per microsecond depending upon the type and composition of the reactive material. Use of the delay trail can provide a 100 microseconds delay with a trail of 2.5 inches compared to 25 inches for an ordinary explosive path.

As illustrated in FIG. 2, a second explosive trail of secondary explosive 14 branches off of the first explosive trail prior to the termination of the first explosive trail at the delay explosive trail 12. Second explosive trail 14 parallels the run of the delay explosive trail and terminates in explosive switch 15, shown in dotted lines. The delay explosive trail terminates at booster charge 13 which increases the energy of the reaction wave after it exits the delay explosive trail and converts it back into a detonation. Booster charge 13 is only required where the energy of the detonation wave exiting delay trail 12 is insufficient to detonate the secondary explosive trails of explosive switch 15.

As shown in FIG. 2, explosive switch 15, shown in dotted lines, incorporates a gated diode between booster charge 13 and the explosive output device, illustrated here as a warhead. The gated diode is constructed with an explosive loop 16 of secondary explosive which connects the booster charge and the warhead. The diode is also provided with a straight trail of secondary explosive 19 which closes explosive loop 16 and also connects the booster charge to the far side of the loop. The second explosive trail, which parallels the delay explosive trail is connected to straight explosive path 19 at intersection 17 so as to function as a null gate for the explosive diode.

When a detonation wave is propagated from the detonator through the first explosive trail 11 to delay explosive trail 12, the detonation wave creates a second detonation wave which is propagated in the second explosive trail so as to parallel the detonation wave in the delay path. Because of the composition of delay explosive trail 12, the first reaction wave in the delay trail travels at a lesser velocity than the second detonation wave in the second explosive trail. The lessened velocity of the reaction wave in the delay explosive trail allows the detonation wave in the second explosive trail to reach the explosive switch 15 ahead of the delay explosive trail reaction wave. When the detonation wave in the second explosive trail reaches intersection 17 in explosive switch 15, the straight explosive trail 19 is disrupted or consumed because the detonation cannot turn the corner and continue down trail 19. When the delayed detonation wave reaches the booster charge 13 it is increased in energy and propagates a wave in the secondary explosive forming explosive loop 16. The detonation wave proceeds around loop 16 which is designed to counter the "corner effect" and thus allow the detonation wave to proceed on to the warhead or other explosive device.

If a false detonation wave should be initiated in the delay path or booster charge, due to extraneous environmental factors, such that a detonation wave is propagated through delay explosive trail 12 or booster charge 13, by means other than the detonation input, a parallel detonation wave in second explosive trail 14 would not be present. Without a detonation wave in second explosive trail 14, there would be no disruption of straight explosive trail 19 at intersection 17. Without an interruption of straight explosive trail 19, a falsely generated detonation wave in either delay explosive path 12 or booster charge 13 would create a detonation wave which propagates down the undisrupted straight explosive path 19 at the same time a detonation wave was propagated through explosive loop 16. Straight explosive trail 19, due to the shorter length, would allow the detonation wave to reach the far side of explosive loop 16 prior to arrival of the detonation wave traveling through loop 16. Because of the "corner effect," the failure of the detonation wave to turn a sharp or 90° corner which is incorporated at the intersection of straight explosive trail 19 with the far side of explosive loop 16, the explosive loop 16 is disrupted at the intersection of explosive trail 19 such that the detonation wave propagating through loop 16 can not proceed to the warhead.

Figure 3:
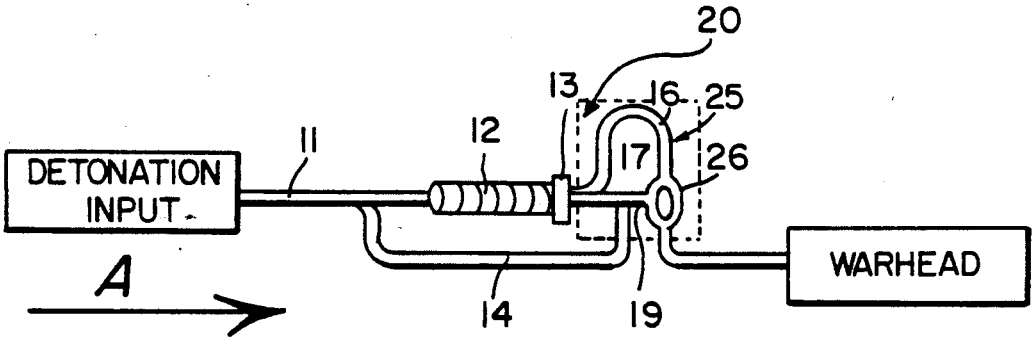
FIG. 3 illustrates a second embodiment of the invention.

Referring now to FIG. 3 there is illustrated a second embodiment of the safe/arm explosive delay path of the present invention wherein the explosive switch 15, of FIG. 2 has been replaced with an explosive switch incorporating a safety junction for increasing the safety of the safe/arm explosive delay path by placing an extra corner between path 19 and the explosive output. Explosive switch 25 incorporates a double corner, safety junction 26 at the intersection of explosive loop 16 and straight explosive trail 19. The safety junction 26 provides two separate corners that must fail in order that detonation wave propagated through explosive trail 17 will arrive at the output. This increases the safety of the delay mechanism without decreasing manufacturing tolerances and thus allows the use of ordinary manufacture means.

Figure 4:
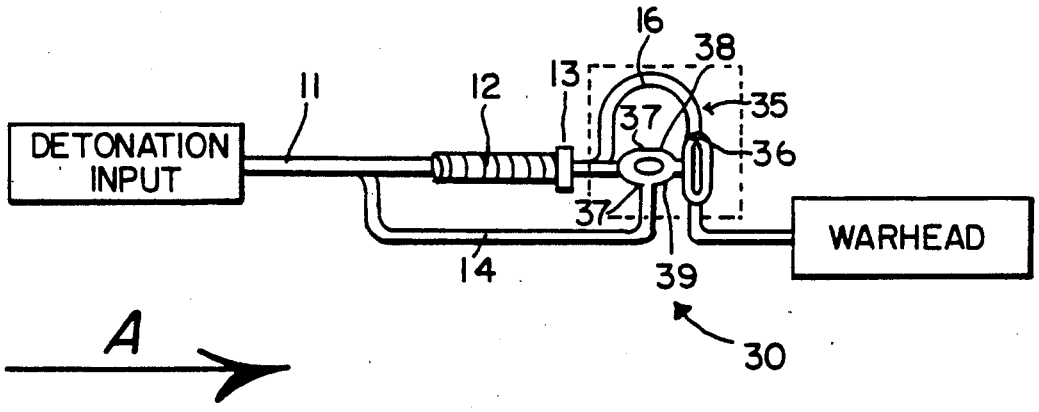
FIG. 4 illustrates a third embodiment of the present invention.

Another embodiment of the invention is illustrated in FIG. 4 wherein the explosive switch 15 of FIG. 2 is replaced with explosive switch 35 which provides safety junctions in straight explosive trail 19 in addition to the safety junction 36 at the intersection of explosive loop 16 and straight explosive trail 19.

Referring again to the safe/arm explosive delay path of FIG. 2, it is contemplated that the explosive switch 15 can also be seen as a safety junction of the ZEROTH level which incorporates only a single trail from loop 16 of the gated diode to the warhead. To increase the safety of the safe/arm explosive delay path, without decreasing manufacturing tolerances requires the incorporation of explosive switches such as those illustrated in FIGS. 3 and 4 as switches 25 and 35. Although the invention is illustrated with one detonator and delay path per warhead, it is contemplated that a warhead could be provided with as many delay paths and detonators as necessary.

It is thus apparent that the disclosed safe/arm explosive delay path provides a means for detonating explosive devices while preventing inadvertent detonation due to extraneous environmental factors. The explosive delay path provides for reliable and safe detonation of the explosive devices by providing an explosive delay trail in a reduced length from that normally required with ordinary or secondary explosive.

Many obvious modifications and embodiments of the specific invention other than those set forth above will readily come to mind to one skilled in the art having the benefit of the teachings presented in the foregoing description and the accompanying drawings of the subject invention, and hence it is to be understood that such modifications are included within the scope of the appended claims.

What is claimed as new and desired to be secured by Letters Patent of the United States is:

1. A safe/arm explosive delay path for detonating an explosive device, comprising:

input means;

delay means;

means parallel to the delay means; and a safety junction positioned between the delay means and the explosive device;

whereby, when a signal is provided to the input means, said signal is transmitted by the input means to both the delay means and the parallel means and then to the safety junction with the signal from the parallel means arriving at the safety junction prior to the signal from the delay means so as to enable the safety junction to pass the signal from the delay means to the explosive device.

2. The delay path of claim 1 wherein the input means comprises a detonator and a trail of explosive.

3. The delay path as in claim 1 wherein the delay means has a detonation velocity less than the detonation velocity o the parallel means.

4. The delay path of claim 1 wherein the delay means comprises a trail of explosive material having a detonation velocity less than the detonation velocity of ordinary explosive.

5. The delay path of claim 4 wherein the explosive material has a detonation velocity of ½ to 1/10 the velocity of ordinary explosive.

6. The delay path of claim 4 wherein the explosive material is a mixture of explosive and reactive material.

7. The delay path of claim 4 wherein the safety junction is an explosive switch.

8. The delay path of claim 4 wherein the safety junction is a gated explosive diode.

9. A safe/arm explosive delay path for detonating an explosive device, comprising:

a detonator and first explosive trail, said detonator initiating a detonation signal in the first explosive trail;

a delay explosive trail having a detonation velocity less than the detonation velocity of ordinary explosive;

a second trail of explosive connected to the first explosive trail and parallel to the delay explosive trail; and a safety junction connected to the delay explosive trail and the parallel explosive trail;

whereby, when a signal is applied to the detonator, said signal is transmitted by the first explosive trail as a detonation wave to both the delay explosive trail and the parallel explosive trail and then to the safety junction with the signal from the parallel explosive trail arriving at the safety junction prior to the signal from the delay explosive trail so as to enable the safety junction to pass the signal from the delay explosive path to the explosive device.

10. The delay path as in claim 9 wherein the safety junction is an explosive switch.

11. The delay path as in claim 8 wherein the explosive delay path has a reaction velocity less than the detonation velocity of the second explosive trail.

12. The delay path as in claim 9 wherein the safety junction is a gated explosive diode.

13. The delay path as in claim 12 wherein the parallel explosive trail leads to the gate of the gated explosive diode.

14. A safe/arm explosive delay path for preventing inadvertent detonation of an explosive device by extraneous factors, comprising:

means initiating a detonation wave;

means delaying the detonation wave;

means propagating a second detonation wave parallel to the delayed detonation wave; and explosive logic means connected to the delay means, the explosive device, and the means propagating a second detonation wage, said explosive logic means allowing the delay detonation wave to proceed to the explosive device only when the second parallel detonation wave precedes the delay detonation wave to the explosive logic means.

15. The delay path as in claim 14 wherein the explosive logic means is an explosive switch.

16. The delay path as in claim 14 wherein the means delaying the detonation is an explosive trail having a detonation velocity less than the detonation velocity of ordinary explosive.

17. The delay path as in claim 14 wherein the means delaying the detonation is a reactive trail.

18. The delay path as in claim 14 wherein the means delaying the detonation is an explosive trail having a reaction velocity that is ½ to 1/10 the detonation velocity of ordinary explosive.

19. The delay path as in claim 14 wherein the explosive logic means is a gated explosive diode.

20. The delay path as in claim 19 wherein the means propagating a second explosive wave gates the explosive diode.

* * * * *